US005573123A

United States Patent [19]

LaLonde

[11] Patent Number: 5,573,123

[45] Date of Patent: Nov. 12, 1996

[54] CANTILEVERED BOTTLE SUPPORT CAPABLE OF INCORPORATING ANY DESIRED SHAPE OR GRAPHIC DESIGN

[76] Inventor: Aaron D. LaLonde, 39392 Blacow Rd., Fremont, Calif. 94539

[21] Appl. No.: 292,833

[22] Filed: Aug. 18, 1994

[51] Int. Cl.[6] ..... A47F 7/00

[52] U.S. Cl. ..... 211/74; D7/701; 248/312

[58] Field of Search ..... 211/74; 248/312; D7/701, 706, 708; D6/468, 469, 473

[56] References Cited

U.S. PATENT DOCUMENTS

| | | | |
|---|---|---|---|
| D. 253,802 | 1/1980 | Loud et al. | D7/708 |
| 3,981,491 | 9/1976 | Snyder | 211/22 X |
| 4,494,788 | 1/1985 | Altemose | D7/706 X |
| 4,496,124 | 1/1985 | Cole | 248/146 |
| 4,795,038 | 1/1989 | Johnson | D7/701 X |
| 5,180,066 | 1/1993 | McArdle | 211/74 |
| 5,197,612 | 3/1993 | Thompson | 248/312 X |

FOREIGN PATENT DOCUMENTS

| | | | |
|---|---|---|---|
| 0066005 | 12/1982 | European Pat. Off. | 211/74 |
| 1543394 | 10/1968 | France | 211/74 |

*Primary Examiner*—Robert W. Gibson, Jr.
*Attorney, Agent, or Firm*—Jim Hillman

[57] ABSTRACT

A holder for objects, such as wine bottles, having a support system that enables the objects' enclosures to be any desired shape or form. A preferred embodiment includes a bottle support that is cantilevered in two directions. The first direction is parallel to the longitudinal length of the bottle and the second direction is orthogonal thereto. A support foot that is in general orthogonal to the supported bottle and a support arm connecting the support foot to the support body provides the ability to cantilever the supported object in two directions.

16 Claims, 11 Drawing Sheets

CANTILEVERED BOTTLE SUPPORT CAPABLE OF INCORPORATING ANY DESIRED SHAPE OR GRAPHIC DESIGN

BACKGROUND OF THE INVENTION

A. Field of the Invention

The invention relates in general to a cantilevered bottle support and in particular to a cantilevered bottle support having a support foot that is disposed oblique to the direction of the supported bottle to provide for both supporting the bottle and incorporating any desired graphic design.

B. Description of the Prior Art

There are a multiplicity of support schemes for holding and displaying objects, particularly bottles. Conventional cases and racks support bottles horizontally, vertically, and in the case of wine bottles, even at predetermined angles so as to keep the cork moistened so as to hermetically seal the cork. Some bottle holders cantilever the bottle in the direction of its length by gripping the neck of the bottle. U.S. Pat. Nos. 5,180,066; 5,197,612; and 4,795,038 are typical examples of bottle support systems that cantilever the bottle by having the neck of the bottle pass through an opening in an upstanding plane. U.S. Pat. Nos. 4,496,124 and Des. 329,781 are designed to provide that the upstanding plane, with cantilevered bottle inserted therethrough, be self balancing in an upright position.

Where support legs are attached to or incorporated in bottle holders of the Prior Art they are aligned with the direction of the bottle length. Even U.S. Pat. No. Des. 329,781 has a base that is elongated in the direction of the cantilevered bottle. The support legs of the prior art are aligned in this direction in order to provide a stable base for the bottle support. The bottle support will be stable over its base if the center of gravity of the combination of the support base and the supported bottle lies within the footprint of the support legs. When this occurs, the combination of the bottle and the bottle support will be self supporting—that is they will remain upright when placed on a horizontal surface. Hence support legs, when they are used, extend in the direction of the supported bottle in order to provide this self supporting function.

In all of these examples of the prior art, form follows function, that is the form or shape of the bottle support is dictated by the method of support. It would be desirable to have the form of the support system be independent of the support function so as to incorporate any desired graphic design onto the bottle support and still enable the desired support function.

SUMMARY OF THE INVENTION

Briefly the present invention is a holder for objects, such as wine bottles, having a support system that enables the objects' enclosures to be any desired shape or form. The support system includes a support arm that is attached in the conventional manner to the object enclosure at a predetermined oblique angle. The support arm may be attached to or inserted in a fixed structure in the conventional manner or may be attached to a support foot again at a predetermined oblique angle so as to enable free standing support on any desired fixed supporting surface. Preferred embodiments of the invention include an object enclosure comprising a support body of a desired aesthetic form having an opening into which the necked configuration of a wine bottle may be inserted. The predetermined oblique angles of the support arm and the support foot are arranged so that the combined center of gravity of the supported wine bottle, the support body, the support arm and the support foot is above a point within the base of the support foot so to enable the combination to be free standing and supported solely by the support foot independent of the angle the support body takes with the supporting surface.

BRIEF DESCRIPTION OF THE DRAWINGS

The invention may be understood and further advantages and uses thereof more readily apparent, when considered in view of the following detailed description of the exemplary embodiments, taken with the accompanying drawings in which.

DESCRIPTION OF THE PREFERRED EMBODIMENTS

Figure 1:
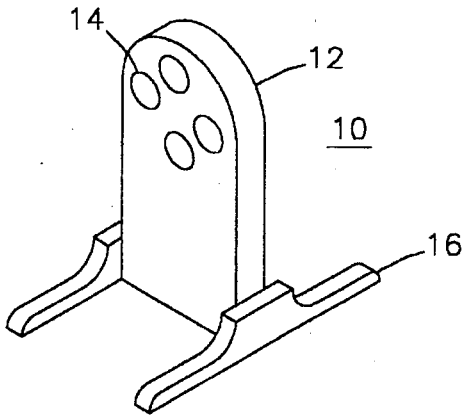
Fig 1 (PRIOR ART)
FIG. 1 is an isometric view of a bottle support constructed according to the teachings of the Prior Art.

Referring now to FIG. 1 there is shown a bottle support of the prior art 10 including body 12 having a multiplicity of holes 14 into which the necked configuration of wine bottles may be inserted. Support members 16 extend front and back from body 12 in a direction parallel to the supported wine bottles so as to provide stability in the parallel direction. The width of body 12 separates support members 16 so as to provide stability in the perpendicular direction (perpendicular to the direction of the supported bottle). The shape of body 12 is therefore required to be rectangular or at least to have an elongated base to provide separation of support members 16.

Figure 2:
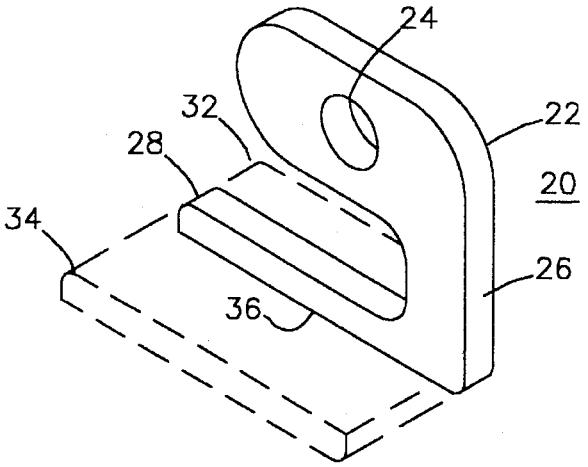
FIG. 2 is an isometric view of a bottle support constructed according to the teachings of the Invention.

Referring now to FIG. 2 there is shown bottle support 20 constructed according to the teachings of the invention. Bottle support 20 includes body 22 having a hole 24 bored therethrough into which the necked configuration of a wine bottle may be inserted. Body 22 is integrally attached to support arm 26 which in turn is integrally attached to support foot 28 which extends orthogonally to the direction of the supported bottle so as to provide stability in the orthogonal direction. Because support foot 28 provides stability in the orthogonal direction, please note that body 22 is no longer required to have a rectangular configuration nor even have an elongated base. As shown body 22 may be attached and supported by a narrow support arm 26. Now if additional support for body 22 is desired in the parallel direction, support foot 28 may be elongated as shown drawn in phantom at 32 or incorporate support members 34 (again drawn in phantom). Note that a support arm and support foot 28 are shown orthogonal to each other and in the same plane, but this is not required. Support arm 26 may be disposed at any suitable oblique angle to body 22 and support foot 28 may be disposed at any suitable oblique angle to support arm 26 in the generally orthogonal direction to the direction of the supported bottle. Alternately, support arm 26 may also be located at any desirable axial position along and between support foot 28 and body 22.

Body 22, support arm 26 and support foot 28 may extend upward from the base 36 of foot 28 at a predetermined angle so that the combined center of gravity of the supported bottle and bottle support 20 lies above the base 36 of foot 28 so as to be free standing. Please note that in this case the supported bottle is cantilevered in two directions, that is in the direction :parallel to the bottle due to the necked grip in hole 24 and the orthogonal/perpendicular to the bottle direction by means of support foot 28 and support arm 26.

Figure 3:
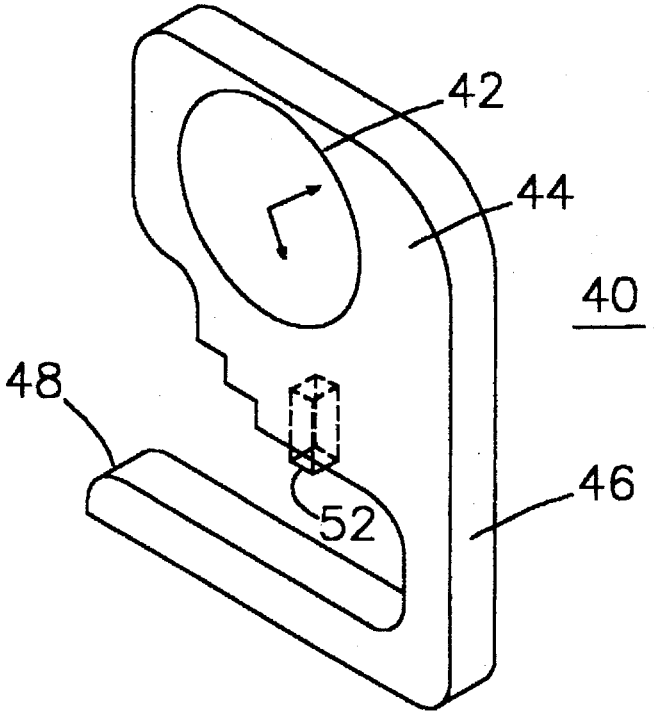
FIG. 3 is an isometric view of a clock support constructed according to the teachings of the Invention.
Figure 4:
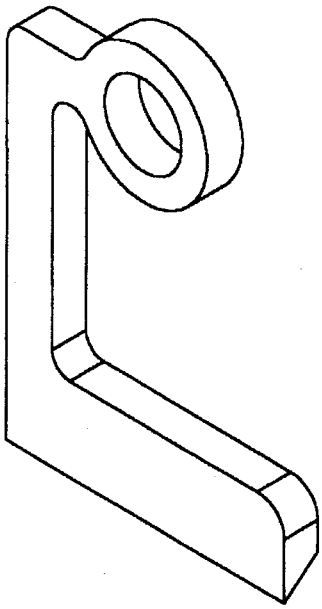
FIG. 4 is an isometric view of another bottle support constructed according to the teachings of the Invention.
Figure 7:
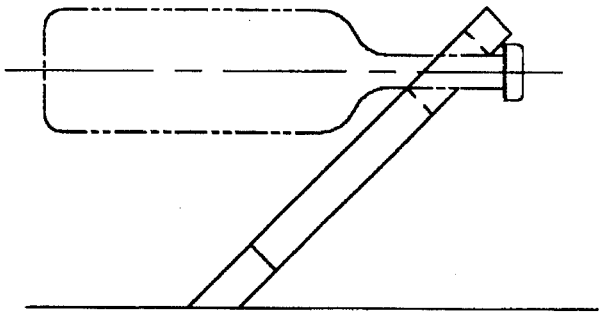
FIG. 7 is an elevational view of the bottle support of FIG. 4.
Figure 5:
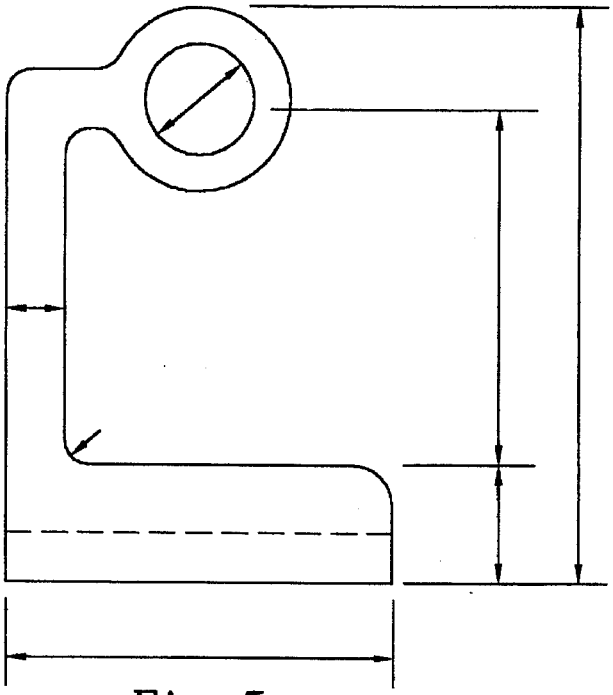
FIG. 5 is a front view of the bottle support of FIG. 4.
Figure 6:
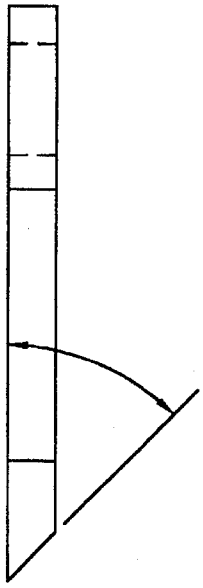
FIG. 6 is a side view of the bottle support of FIG. 4.
Figure 8:
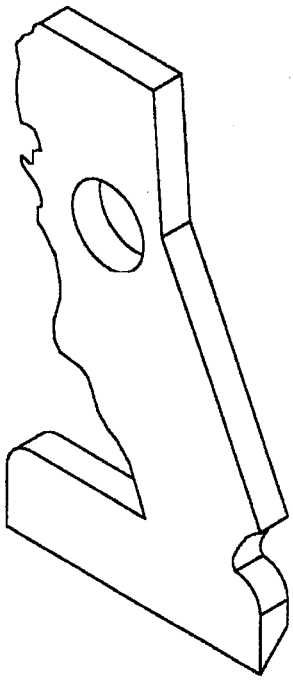
FIG. 8 is an isometric view of another bottle support constructed according to the teachings of the Invention.
Figure 11:
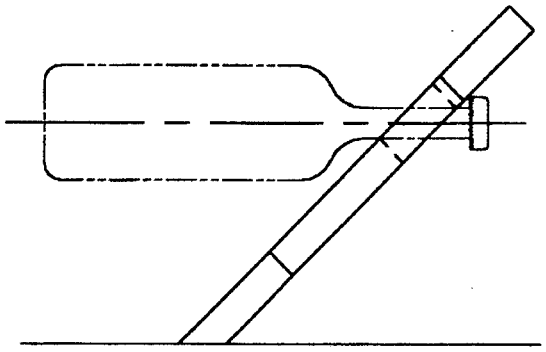
FIG. 11 is an elevational view of the bottle support of Figure.
Figure 12:
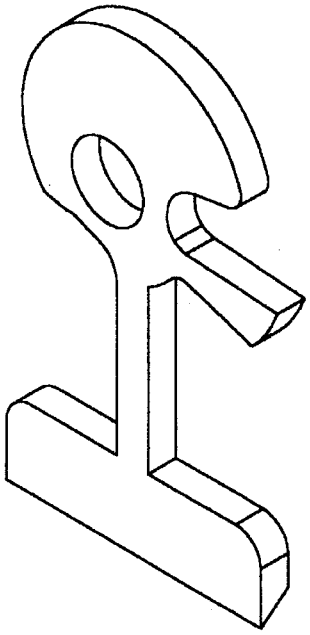
FIG. 12 is an isometric view of another bottle support constructed according to the teachings of the Invention.
Figure 15:
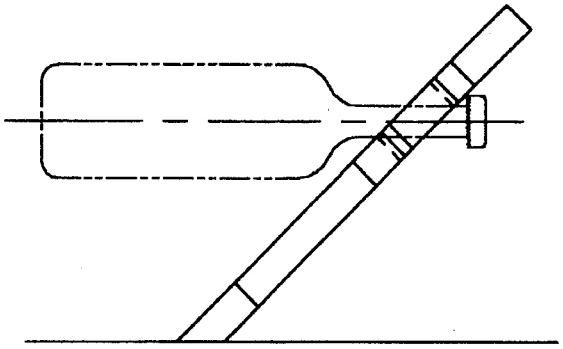
FIG. 15 is an elevational view of the bottle support of FIG. 12.
Figure 9:
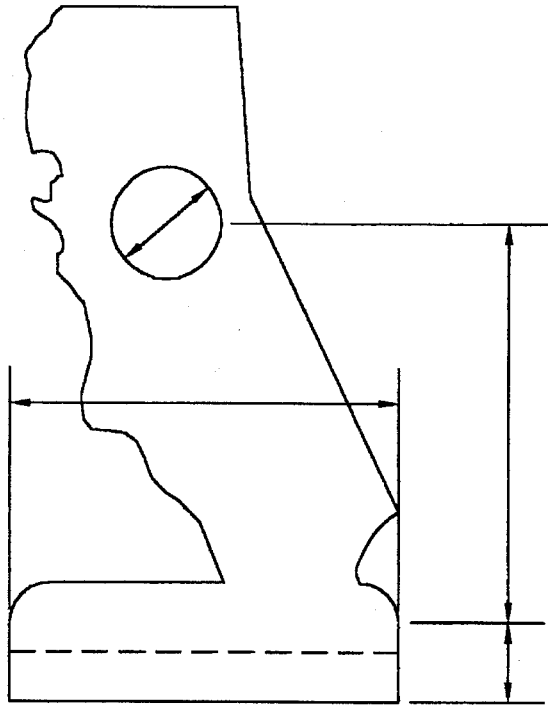
FIG. 9 is a front view of the bottle support of FIG. 8.
Figure 10:
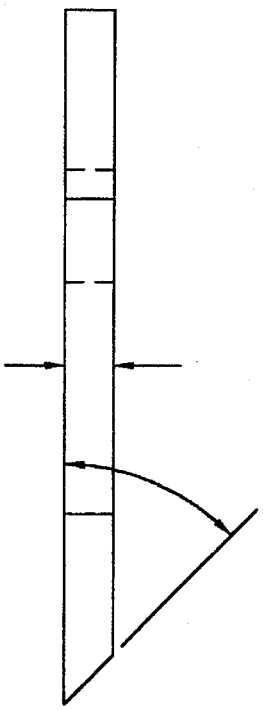
FIG. 10 is a side view of the bottle support of FIG. 8.
Figure 13:
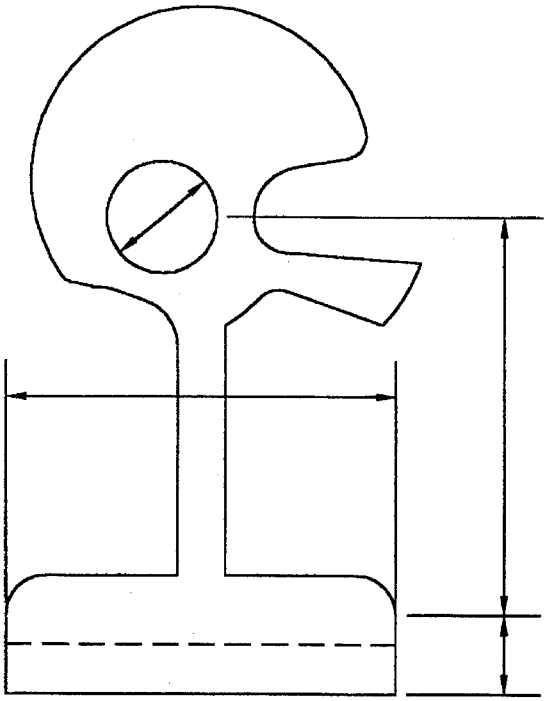
FIG. 13 is a front view of the bottle support of FIG. 12.
Figure 14:
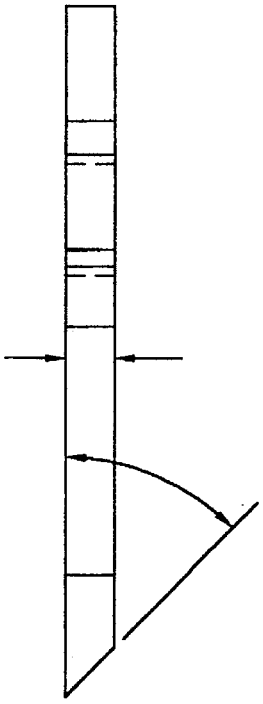
FIG. 14 is a side view of the bottle support of FIG. 12.
Figure 16:
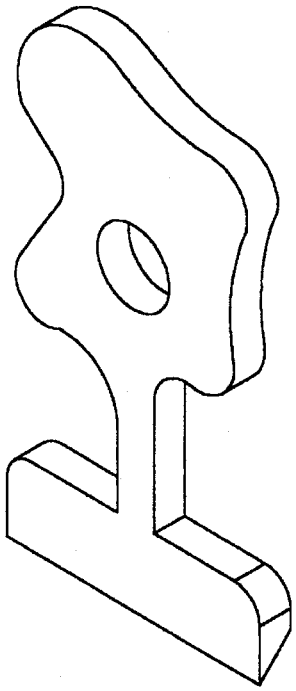
FIG. 16 is an isometric view of another bottle support constructed according to the teachings of the Invention.
Figure 19:
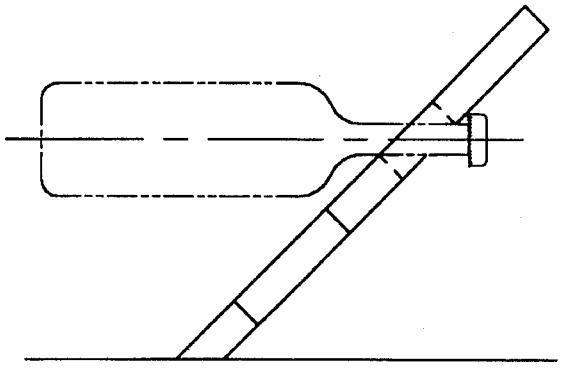
FIG. 19 is an elevational view of the bottle support of FIG. 16.
Figure 17:
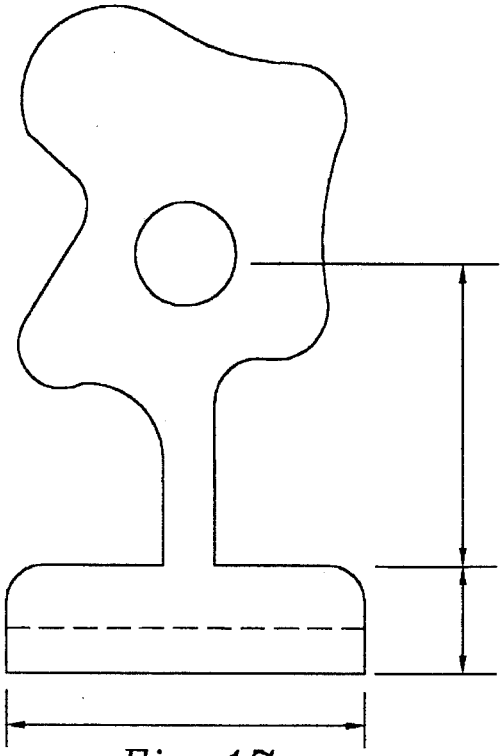
FIG. 17 is a front view of the bottle support of FIG. 16.
Figure 18:
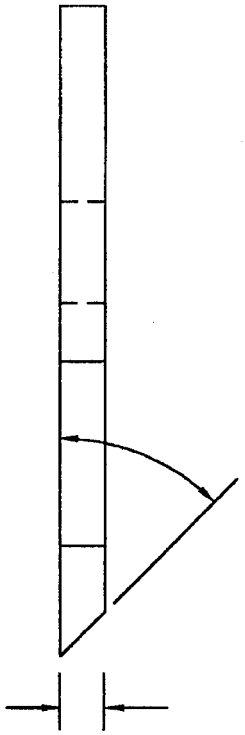
FIG. 18 is a side view of the bottle support of FIG. 16.
Figure 20:
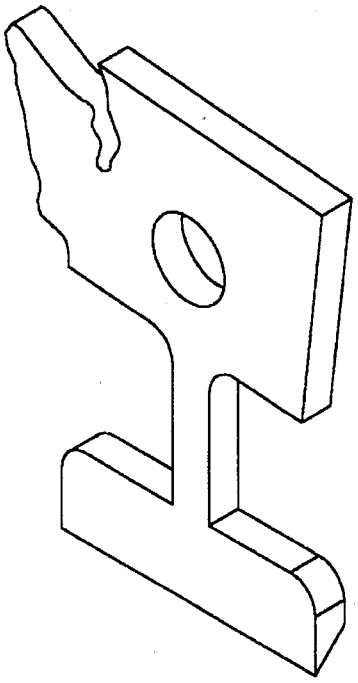
FIG. 20 is an isometric view of another bottle support constructed according to the teachings of the Invention.
Figure 23:
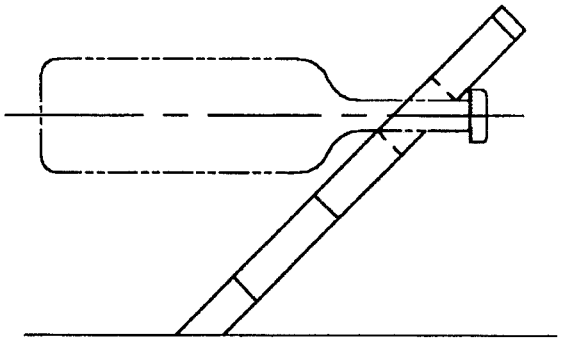
FIG. 23 is an elevational view of the bottle support of FIG. 20.
Figure 21:
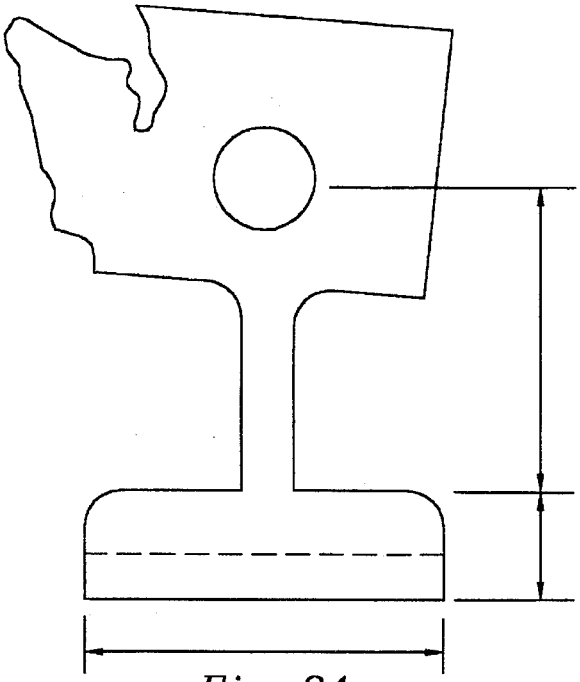
FIG. 21 is a front view of the bottle support of FIG. 20.
Figure 22:
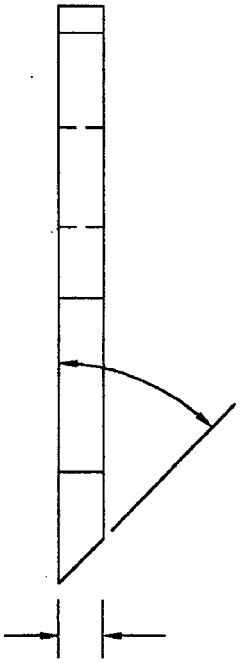
FIG. 22 is a side view of the bottle support of FIG. 20.
Figure 24:
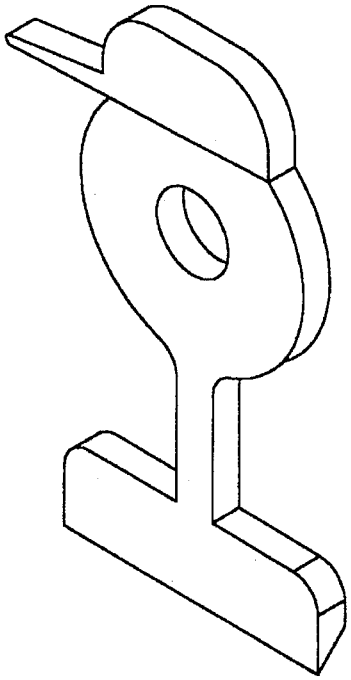
FIG. 24 is an isometric view of another bottle support constructed according to the teachings of the Invention.
Figure 27:
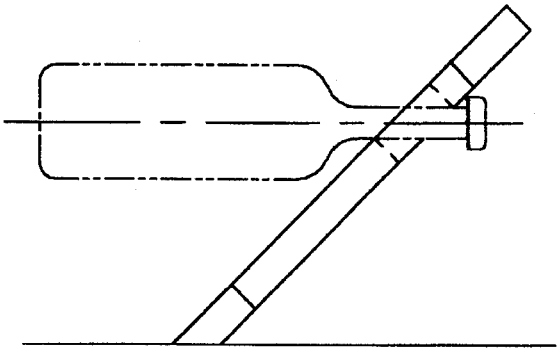
FIG. 27 is an elevational view of the bottle support of FIG. 24.
Figure 25:
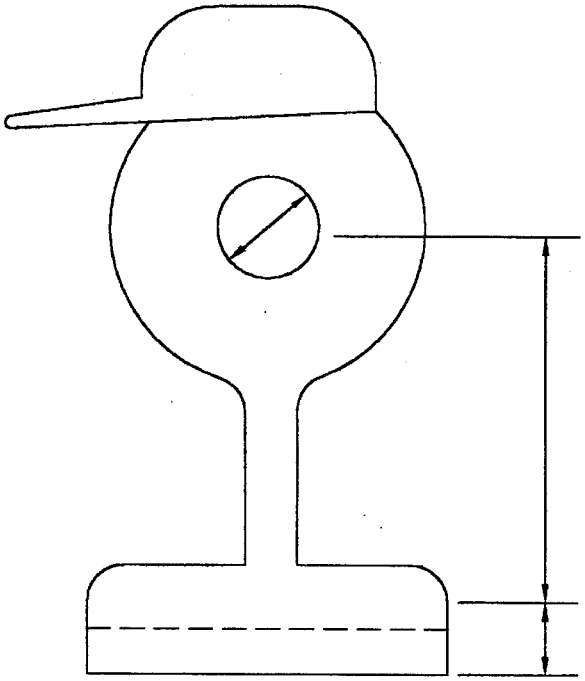
FIG. 25 is a front view of the bottle support of FIG. 24.
Figure 26:
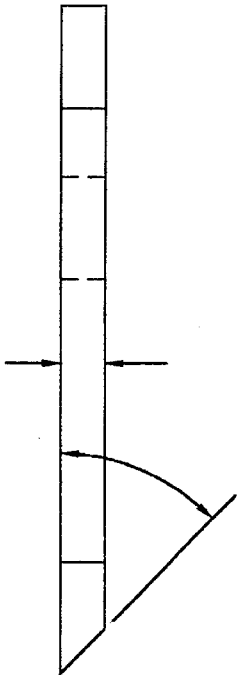
FIG. 26 is a side view of the bottle support of FIG. 24.
Figure 28:
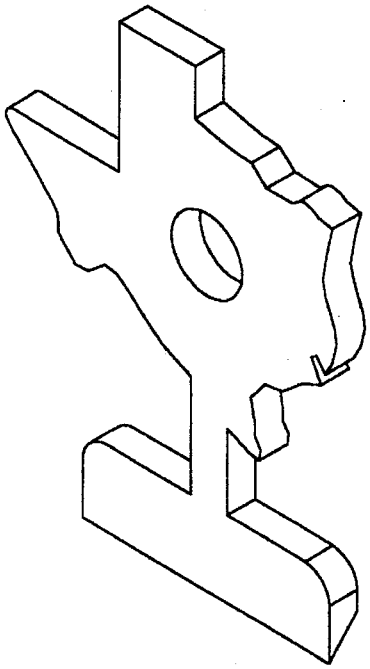
FIG. 28 is an isometric view of another bottle support constructed according to the teachings of the Invention.
Figure 31:
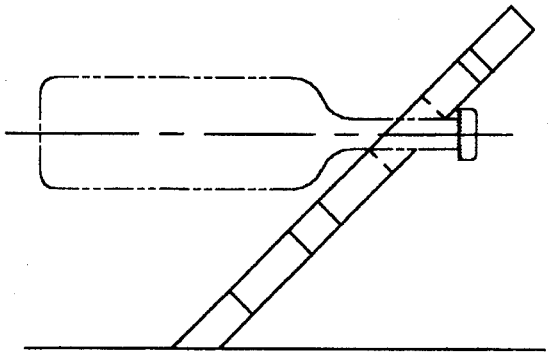
FIG. 31 is an elevational view of the bottle support of FIG. 28.
Figure 29:
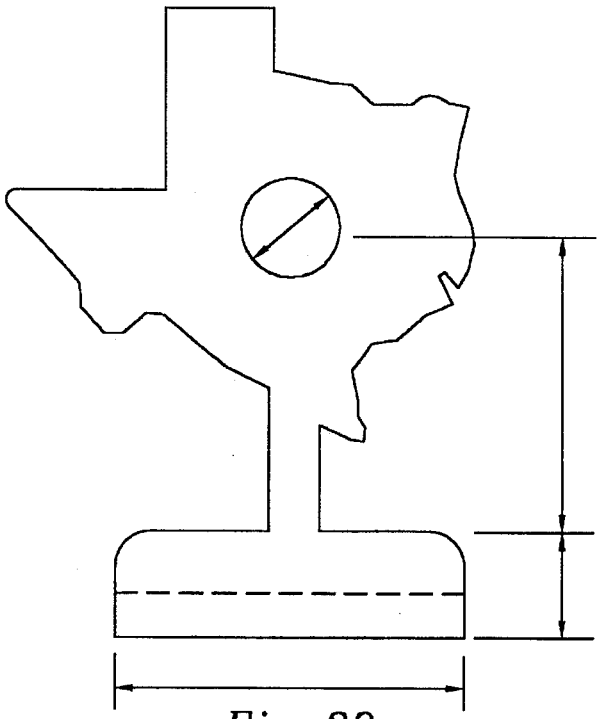
FIG. 29 is a front view of the bottle support of FIG. 28.
Figure 30:
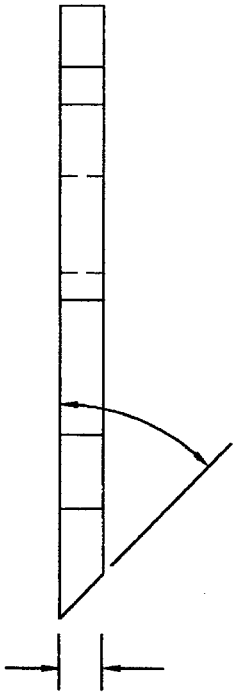
FIG. 30 is a side view of the bottle support of FIG. 28.
Figure 32:
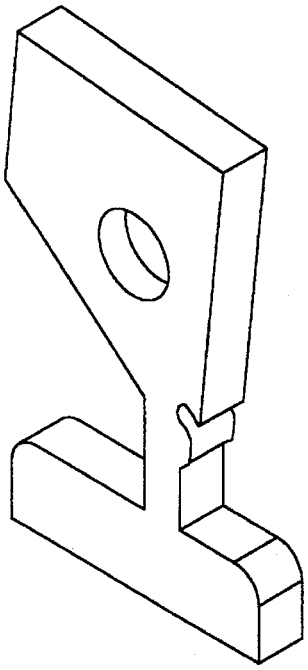
FIG. 32 is an isometric view of another bottle support constructed according to the teachings of the Invention.
Figure 35:
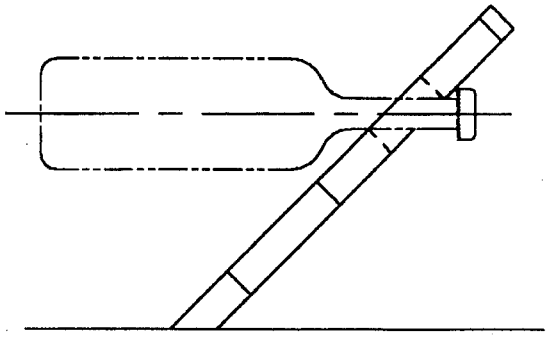
FIG. 35 is an elevational view of the bottle support of FIG. 32.
Figure 33:
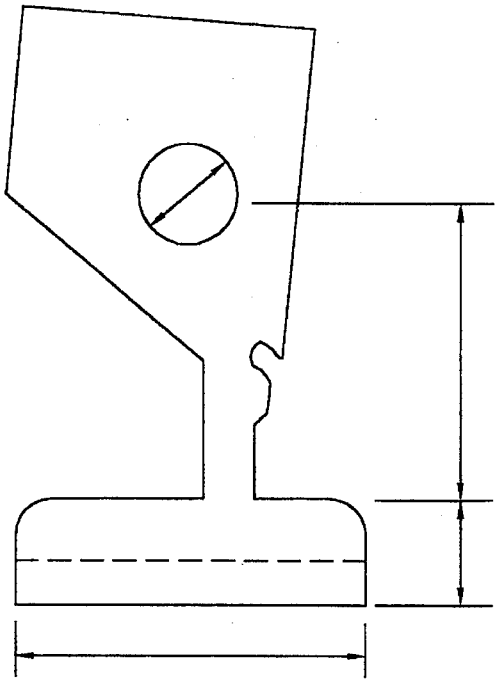
FIG. 33 is a front view of the bottle support of FIG. 32.
Figure 34:
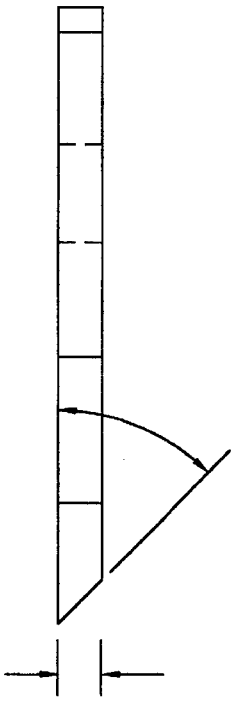
FIG. 34 is a side view of the bottle support of FIG. 32.
Figure 36:
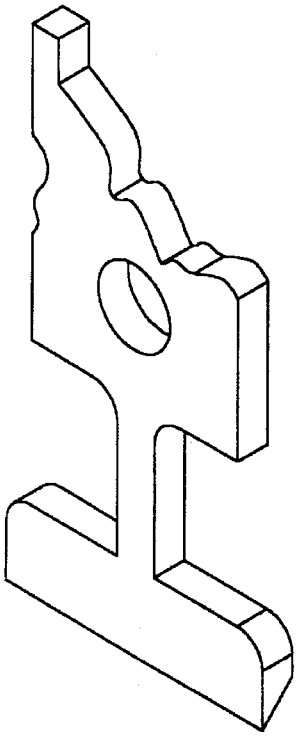
FIG. 36 is an isometric view of another bottle support constructed according to the teachings of the Invention.
Figure 39:
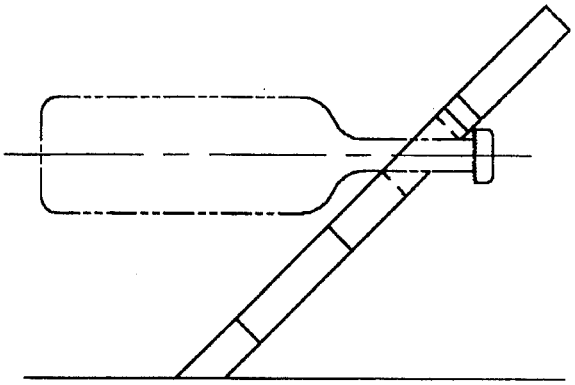
FIG. 39 is an elevational view of the bottle support of FIG. 36.
Figure 37:
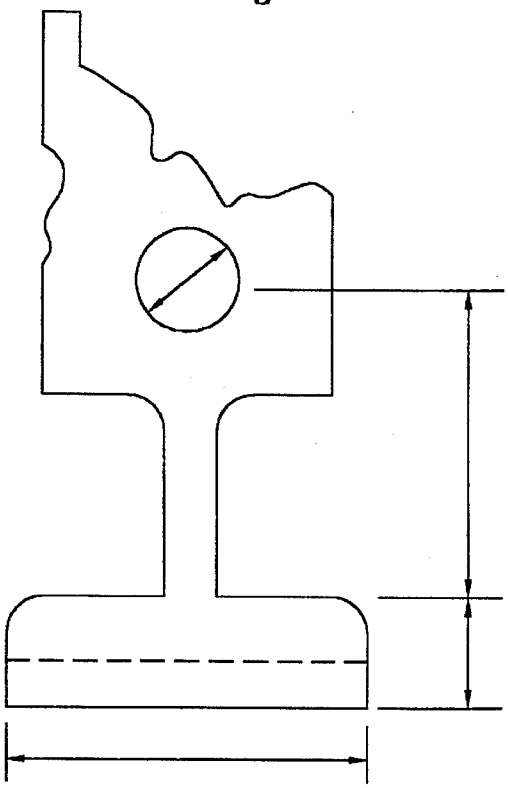
FIG. 37 is a front view of the bottle support of FIG. 36.
Figure 38:
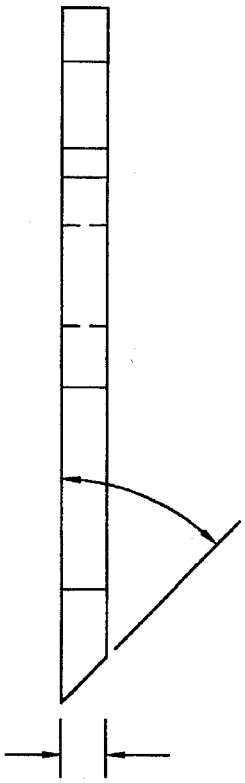
FIG. 38 is a side view of the bottle support of FIG. 36.

Referring now to FIG. 3 there is shown object support 40 which now supports a clock 42 by means of support body 44, support arm 46, and support foot 48 which will function as described for bottle support 20 of FIG. 2. Object support 40 can be provided additional support by means of brace 52 so as to provide a tripod support framework. Again the use of support foot 48 allows support body 42 to assume any shape desired for aesthetic purposes while providing cantilevered support in combination with support arm 46.

FIGS. 4–39 show examples of desired aesthetic forms that may be supported by the combination of a support foot and a support arm as taught by the invention.

Figure 40:
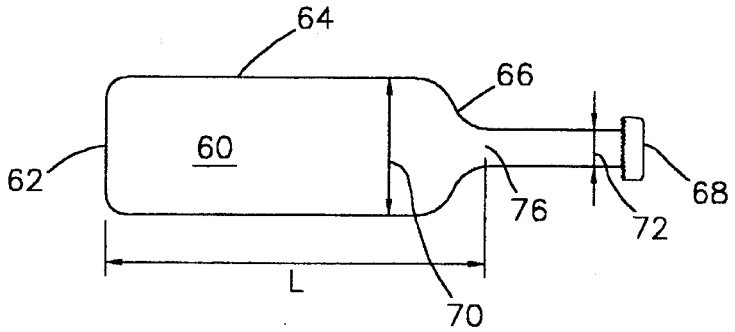
FIG. 40 is a schematic view of a bottle showing the method for determining the correct diameter of the hole that is disposed in the bottle support.

Referring now to FIG. 40 there is shown the method for calculating the diameter and the position of the hole 14 that is disposed in body 22 of bottle support 20 (FIG. 2). Bottle 60 includes bottom end 62, body portion 64 and necked down portion 66. Diameters 70 and 72 are measured at the hole contact points of the shoulder portion 66 and the stoppered portion 68 which is capped or corked to maintain full fluid level as is well known in the art. Diameters 70 and 72 are averaged and this average diameter is doubled to give the diameter of the hole. Mid point 76 between diameters 70 and 72 is computed and the length between midpoint 72 and bottom end 62 is measured. One half of this length L is used as the x and y coordinates for the location of the center of the hole 24 when bottle support 20 extends upwards from its support base at an angle of 45 degrees. This results in bottle 60 being held in a horizontal position by bottle support 20. When a wood material having a thickness of ¾ of an inch is used for bottle support 20 a hole diameter of 2 inches works very well but the invention is not to be so limited.

In conclusion although the invention was developed for a single plane cantilevered and free standing counterbalanced bottle support, the breadth of the invention is not to be considered so limited. Rather the teachings of the invention are broadly applicable to any object (or in particular bottle) support that cantilevers the supported object (or bottle) in a direction perpendicular to the direction of the length of the supported object (or bottle). Similarly, although wood was used for the material of the preferred embodiments, the invention is not to be limited thereto. The object support system of the invention may be made of any rigid material such as for example plastics, acrylics, resins, and wood composites.

I claim:

1. A bottle support for cantilevered support of a bottle in two orthogonal directions, comprising:

a body having means for holding at least one bottle in a first cantilevered position; and a support arm disposed at a first predetermined angle to said body for supporting said body at a second cantilevered position orthogonal to said first cantilevered position.

2. The bottle support of claim 1 further including balancing means on said body for free standing balancing of said body, support arm and said supported bottle.

3. A bottle support for cantilevered support of a bottle in two orthogonal directions, comprising:

a body having a hole bored through said body suitable for receiving the necked configuration of a bottle to provide for supporting said bottle in a first orthogonal direction from said body; and a support arm disposed at a first predetermined angle to said body for supporting said body at a second cantilevered position orthogonal to said first cantilevered position.

4. The bottle support of clam 3 wherein said first predetermined angle is 90 degrees.

5. The bottle support of claim 4 wherein the bottle support further includes a support foot disposed at a second predetermined angle to the support arm and extending in a direction orthogonal to the direction of the supported bottle.

6. The bottle support of claim 5 wherein said second predetermined angle is 90 degrees.

7. The bottle support of claim 6 wherein said support foot and said support arm are rigidly attached to one another.

8. The bottle support of claim 7 wherein said support arm and said body are in the same plane.

9. The bottle support of claim 8 wherein said support arm and support body are integral with one another.

10. The bottle support of claim 9 wherein said support foot, support arm and support body are rigidly attached to one another.

11. The bottle support of claim 10 wherein said support foot, support arm and support body are in the same plane.

12. The bottle support of claim 11 wherein said support foot is supported by base members that extend in a direction parallel to the supported bottle to provide additional stability in the parallel direction.

13. A bottle support for supporting a bottle above a supporting surface, comprising:

a) a body having at least one hole bored through said body suitable for receiving the necked configuration of a bottle;

b) a support arm disposed at a first predetermined angle to said body for supporting said body at a first predetermined position;

c) a support foot disposed at a second predetermined angle to said support arm;

said body, support arm and support foot lie in the same plane, are attached to one another and cooperate to support said bottle above said supporting surface; and d) a tripod foot extending from said body at a predetermined angle toward said supporting surface to provide additional stability in a direction parallel to the supported bottle.

14. The bottle support of claim 13 wherein said support foot, support arm and support body are rigidly attached to one another.

15. The bottle support of claim 14 wherein said support arm and support body are integral with one another.

16. The bottle support of claim 15 wherein said support foot, support arm and support body are in the same plane.

* * * * *